US005161284A

United States Patent [19]

Leifeld

[11] Patent Number: 5,161,284

[45] Date of Patent: Nov. 10, 1992

[54] SLIVER DRAFTING APPARATUS WITH RPM SENSING AND ADJUSTING

[75] Inventor: Ferdinand Leifeld, Kempen, Fed. Rep. of Germany

[73] Assignee: Trützschler GmbH & Co. KG, Mönchengladbach, Fed. Rep. of Germany

[21] Appl. No.: 680,760

[22] Filed: Apr. 5, 1991

[30] Foreign Application Priority Data

Apr. 9, 1990 [DE] Fed. Rep. of Germany ..... 4011417
Feb. 6, 1991 [DE] Fed. Rep. of Germany ..... 4103525

[51] Int. Cl.[5] ..... D01H 5/74
[52] U.S. Cl. ..... 19/260; 19/243
[58] Field of Search ..... 19/236, 237, 238, 239, 19/243, 258, 266, 281, 288, 150, 152, 144, 145.5, 240, 241, 260

[56] References Cited

U.S. PATENT DOCUMENTS

| | | | |
|---|---|---|---|
| 128,618 | 7/1872 | Harris | 19/243 |
| 3,063,101 | 11/1962 | Andreani | 19/243 |
| 4,266,324 | 5/1981 | Hasegawa et al. | 19/239 |
| 4,512,061 | 4/1985 | Hartmannsgruber | 19/239 |
| 4,646,391 | 5/1987 | Wolf | 19/239 |
| 4,703,431 | 10/1987 | Sako et al. | 19/240 |
| 4,742,675 | 5/1988 | Leifeld | 19/240 |
| 4,864,694 | 9/1989 | Konig et al. | 19/240 |

FOREIGN PATENT DOCUMENTS

| | | |
|---|---|---|
| 1510272 | 10/1969 | Fed. Rep. of Germany . |
| 2630224 | 1/1978 | Fed. Rep. of Germany . |
| 3031312 | 4/1982 | Fed. Rep. of Germany . |
| 3315247 | 10/1984 | Fed. Rep. of Germany . |

*Primary Examiner*—Werner H. Schroeder
*Assistant Examiner*—Michael A. Neas
*Attorney, Agent, or Firm*—Spencer, Frank & Schneider

[57] ABSTRACT

A sliver drafting apparatus has a pre-drafting mechanism which simultaneously receives a plurality of running slivers, and includes first and second pairs of drafting rolls between which the slivers pass. The apparatus further has a gathering element disposed downstream of the pre-drafting mechanism for gathering the slivers into a combined sliver and a first delivery roll pair situated downstream of the gathering element for pulling the combined sliver from the gathering element. The apparatus further includes a main drafting mechanism arranged downstream of the first delivery roll pair for receiving the combined sliver therefrom. The main drafting mechanism includes first and second pairs of drafting rolls between which the combined sliver passes. A sliver trumpet is situated downstream of the main drafting mechanism for receiving the combined sliver therefrom; and a second delivery roll pair is situated downstream of the sliver trumpet for pulling the combined sliver from the sliver trumpet.

8 Claims, 3 Drawing Sheets

SLIVER DRAFTING APPARATUS WITH RPM SENSING AND ADJUSTING

BACKGROUND OF THE INVENTION

This invention relates to an apparatus for simultaneously drafting a plurality of running slivers by means of pairwise arranged drafting rolls. The simultaneously drafted running slivers are caused to converge by a gathering element and the combined slivers are withdrawn from the drafting apparatus by a delivery roll pair.

Drafting serves for parallelizing, mixing, cleaning and equalizing the fibers in the sliver and may be performed in conjunction with regulation. Parallelization has a significant effect on the final yarn strength. Tests have shown that for certain applications two drafting processes have to be performed consecutively in order to obtain the required yarn strength. The desired mixing effect for achieving up-to-date sliver quality can be effected by means of a single drafting frame.

According to a prior art arrangement, an apparatus for equalizing the sliver is situated upstream of a drafting frame, as viewed in the direction of sliver run. Both drafting frames receive a plurality of successively arranged running slivers. Between the two drafting frames a sliver storing device is positioned. Such an arrangement is disadvantageous in that it significantly increases manufacturing costs.

SUMMARY OF THE INVENTION

It is an object of the invention to provide an improved drafting apparatus which significantly simplifies the performance of two consecutive drafting steps.

This object and others to become apparent as the specification progresses, are accomplished by the invention, according to which, briefly stated, the sliver drafting apparatus has a pre-drafting mechanism which simultaneously receives a plurality of running slivers, and includes first and second pairs of drafting rolls between which the slivers pass. The apparatus further has a gathering element disposed downstream of the pre-drafting mechanism for gathering the slivers into a combined sliver and a first delivery roll pair situated downstream of the gathering element for pulling the combined sliver from the gathering element. The apparatus further includes a main drafting mechanism arranged downstream of the first delivery roll pair for receiving the combined sliver therefrom. The main drafting mechanism includes first and second pairs of drafting rolls between which the combined sliver passes. A sliver trumpet is situated downstream of the main drafting mechanism for receiving the combined sliver therefrom; and a second delivery roll pair is situated downstream of the sliver trumpet for pulling the combined sliver from the sliver trumpet.

Thus, according to the invention, the first drafting stage (pre-drafting mechanism) is integrated into the inlet zone of the second drafting stage (main drafting mechanism). It is an advantage of such an arrangement that the sliver need not be transported in coiler cans between the two drafting stages. The drafting is carried out at a low speed similar to that at the intake (approximately 100 m/min). A single stand is advantageously utilized for both drafting stages, and sliver guiding elements are being used which are present in any event. The driven drafting rolls may extend along the entire width of the totality of incoming slivers; this simplifies the driving arrangement. It is thus possible to integrate, for example, six individual drafting frames.

According to an advantageous embodiment of the invention, the roll pairs are so constructed that the lower rolls are long, driven rolls, while the upper rolls are non-driven, short pressing rolls provided individually for each sliver. Since each individual sliver is pressed with the same force against the long lower rolls, a bending of the long roll does not pose a problem.

The invention has the following additional advantageous features:

The pre-drafting mechanism has, for the incoming slivers, at least two serially arranged roll pairs extending along the entire width of the apparatus to thus allow a joint drafting of all the slivers. The drafting zone (drafting field) for each incoming sliver has at least two serially arranged roll pairs which perform an individual drafting of the slivers. The pre-drafting mechanism for the incoming slivers has, for each sliver, at least two serially arranged lower rolls which extend along the entire width and for each sliver a separate, individual upper pressing roll is provided. The pressing rolls are individually spring-loaded and are individually or commonly driven. The pre drafting mechanism for the incoming slivers and the downstream-arranged main drafting mechanism are mounted on a common stand. The pre-drafting mechanism and the main drafting mechanism have common traverses and sliver guiding units. The pre-drafting mechanism and the main drafting mechanism are connected to a common control device and a common operational data and quality data sensor system. The pre-drafting mechanism and the main drafting mechanism are connected to a common regulating device. The pre-drafting mechanism and the main drafting mechanism are associated with a common fiber material supplying and removing device.

According to a further feature of the invention, one or more drafting frames are arranged upstream of a mixing line, in the inlet zone thereof. All incoming slivers are together drafted between the drafting rolls in the inlet zone. The driven drafting rolls each extend across all of the running slivers while the top pressing rolls are individual components provided separately for each sliver. The pre-drafting mechanism and the main drafting mechanism have common sliver guiding units, a common control, common operational data and quality data sensing systems, common regulator hardware components and/or common material supplying and removal devices.

If pre-drafting is performed with regulation, the circumferential speed of the rolls for both serially arranged drafting mechanisms may be at least approximately the same and are thus maintained at interdependent speeds. The drafting function of the first (upstream) drafting mechanism is then performed in such a manner that only the speed of the first upstream roll pair is changed according to the sliver quantity and in the downstream drafting mechanism the drafting occurs by an rpm variation of the downstream leading roll pair.

DESCRIPTION OF THE PREFERRED EMBODIMENTS

Figure 1:
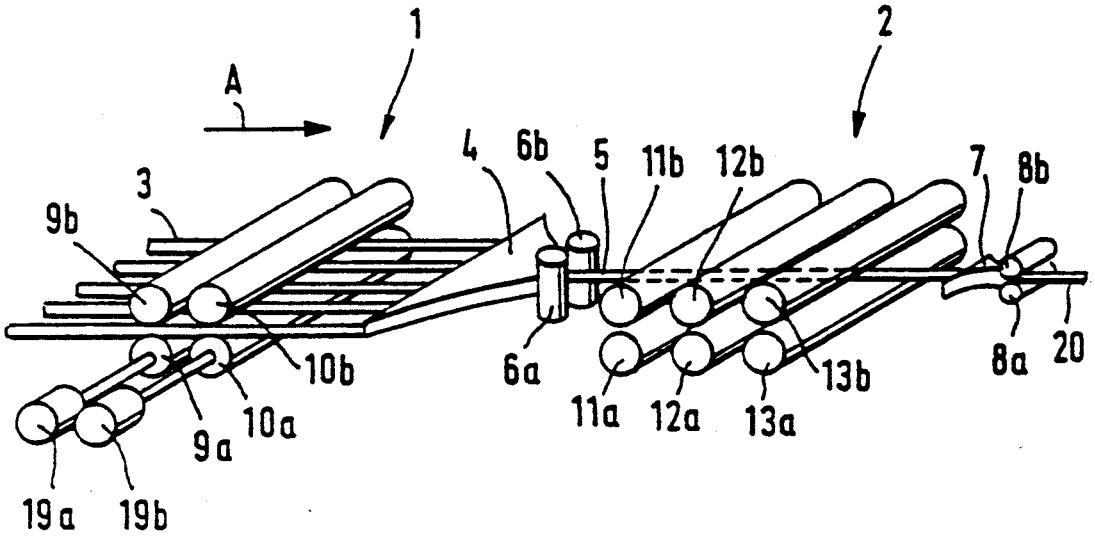
FIG. 1 is a schematic perspective view of a preferred embodiment of the invention.

Turning to FIG. 1, there is illustrated therein a pre-drafting mechanism 1 and, downstream thereof—as viewed in the working direction A—a main drafting mechanism 2. The pre-drafting mechanism 1 receives a plurality of running slivers 3 which, after being drafted and as they exit from the pre-drafting mechanism 1, are gathered by a collecting element 4 and combined into a single sliver 5 which is withdrawn from the pre-drafting mechanism 1 by means of a delivery roll pair formed of cooperating delivery rolls 6*a* and 6*b*. The sliver 5 runs through the main drafting mechanism 2 and, downstream of the exit thereof, passes through a sliver trumpet 7 and is withdrawn by a delivery roll pair formed of rollers 8*a* and 8*b* arranged at the outlet of the trumpet 7. Downstream of the delivery roll pair 8*a*, 8*b* the sliver is designated at 20.

The pre-drafting mechanism 1 includes two driven roll pairs 9*a*, 9*b* and 10*a*, 10*b*. In each roll pair the lower roll 9*a* and 10*a* is stationarily supported whereas the associated upper rolls 9*b* and 10*b* are designed as pressing rolls and are accordingly resiliently supported, for example, in a manner illustrated in FIG. 2. Each lower roll 9*a*, 10*a* of the pre-drafting mechanism 1 is driven by a regulatable drive motor 19*a*, 19*b*, respectively. The main drafting mechanism 2 includes three driven drafting roll pairs 11*a*, 11*b*; 12*a*, 12*b* and 13*a*, 13*b*.

Figure 2:
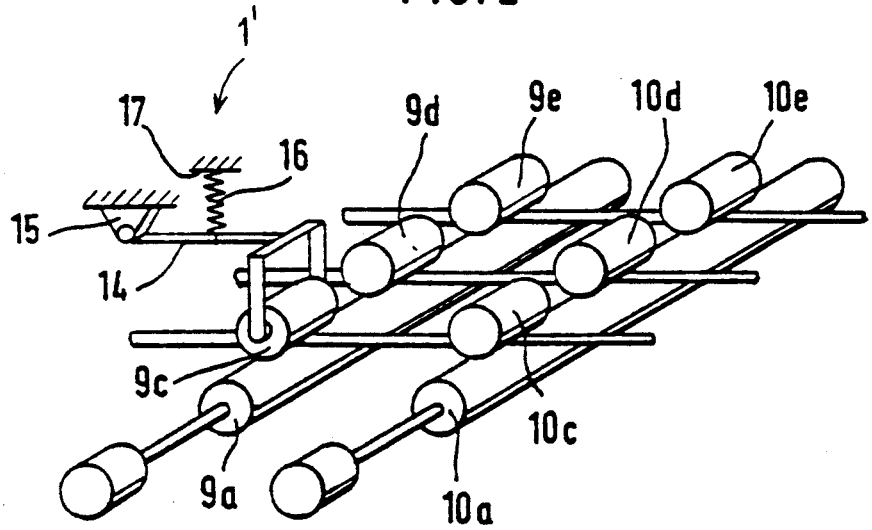
FIG. 2 is a schematic perspective view of another preferred embodiment of the invention.

Turning to the embodiment illustrated in FIG. 2, in the pre-drafting mechanism 1' the lower rolls 9*a* and 10*a* extend throughout the entire width of the apparatus similarly to those shown in FIG. 1. The upper rolls in the FIG. 2 embodiment are formed by individual pressing rolls 9*c*, 9*d*, 9*e* and 10*c*, 10*d*, 10*e*, respectively. All individual pressing rolls—illustrated only for the pressing roll 9*c*—are mounted at an end of a carrier arm 14, whose opposite end is pivotally supported at 15. Each arm 14 is resiliently pressed downwardly by a spring 16 attached to a stationary support 17, whereby each individual upper roll 9*c*, 9*d* and 9*e* is pressed against the single lower roll 9*a* and, likewise, each individual upper roll 10*c*, 10*d* and 10*e* is pressed onto the single lower roll 10*a*.

Figure 3:
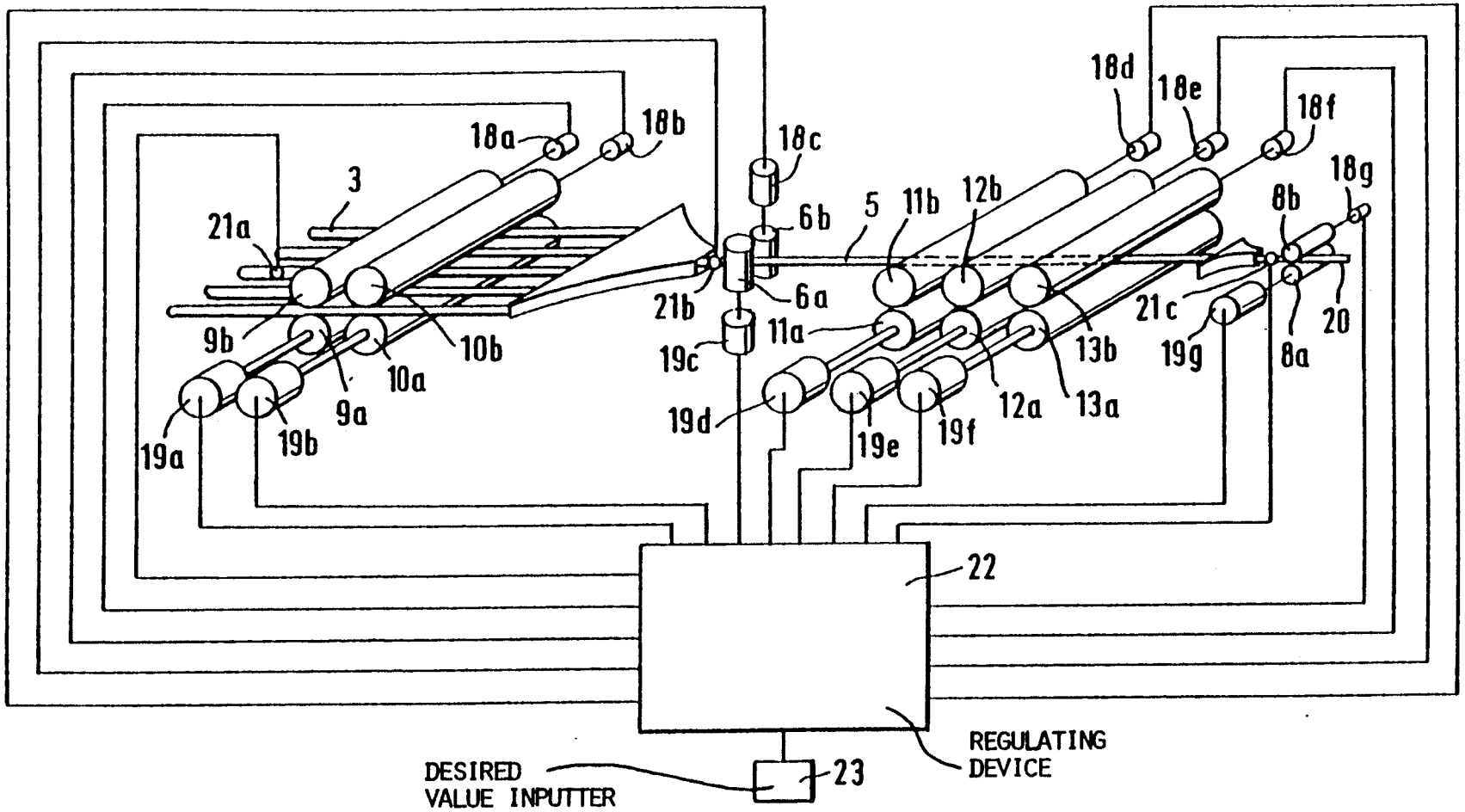
FIG. 3 is a view similar to FIG. 1, additionally including a block diagram to illustrate a control associated with the embodiment shown in FIG. 1.

Turning to FIG. 3, each upper roll 9*b*, 10*b* of the pre-drafting mechanism 1, the delivery roll 6*b*, each upper roll 11*b*, 12*b* and 13*b* of the main drafting mechanism 2 as well as the delivery roll 8*b* are associated with a respective rpm sensor 18*a*–18*g*. Each lower roll 9*a* and 10*a* of the pre-drafting mechanism 1, the delivery roll 6*a*, each upper roll 11*a*, 12*a* and 13*a* of the main drafting mechanism 2 and the delivery roll 8*a* is driven by a separate, regulatable drive motor 19*a*–19*g*, respectively. The slivers 3, at the input of the pre-drafting mechanism 1, the discharged, pre-drafted combined sliver 5 and the sliver 20 discharged by the main drafting mechanism are associated with separate sliver mass sensors 21*a*, 21*b* and 21*c*, respectively. The rpm sensors 18*a*–18*g*, the drive motors 19*a*–19*g* and the sliver mass sensors 21*a*–21*c* are connected to a common control and regulating device 22, such as a microcomputer which has a desired value inputter 23.

Figure 4:
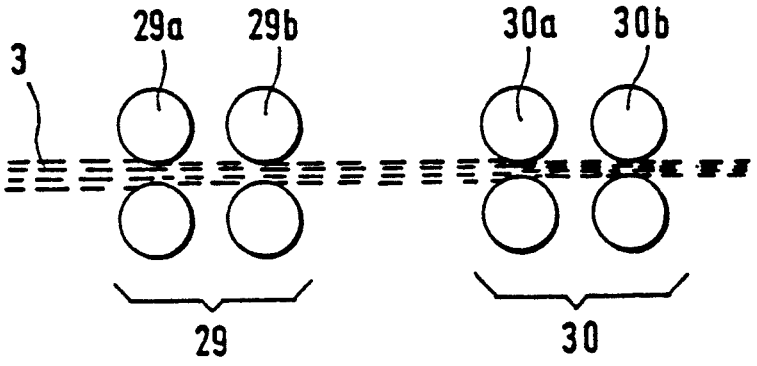
FIG. 4 is a schematic side elevational view of some of the components of the preferred embodiments.

Turning now to FIG. 4, in case the sliver 3 is pre-drafted in a regulated manner, the circumferential speeds of the roll pairs 29*a*, 29*b* remain at least approximately the same, that is, they are interdependent. The drafting in the drafting mechanism 29 is achieved by changing the rpm only of the roll pair 29*a* as a function of the measured mass of the sliver 3 and in the drafting mechanism 30 the change of the drafting effect is achieved by the regulated roller pair 30*b*. The mass of the slivers 3 is determined by mechanical, capacitive or similar sensors.

Figure 5:
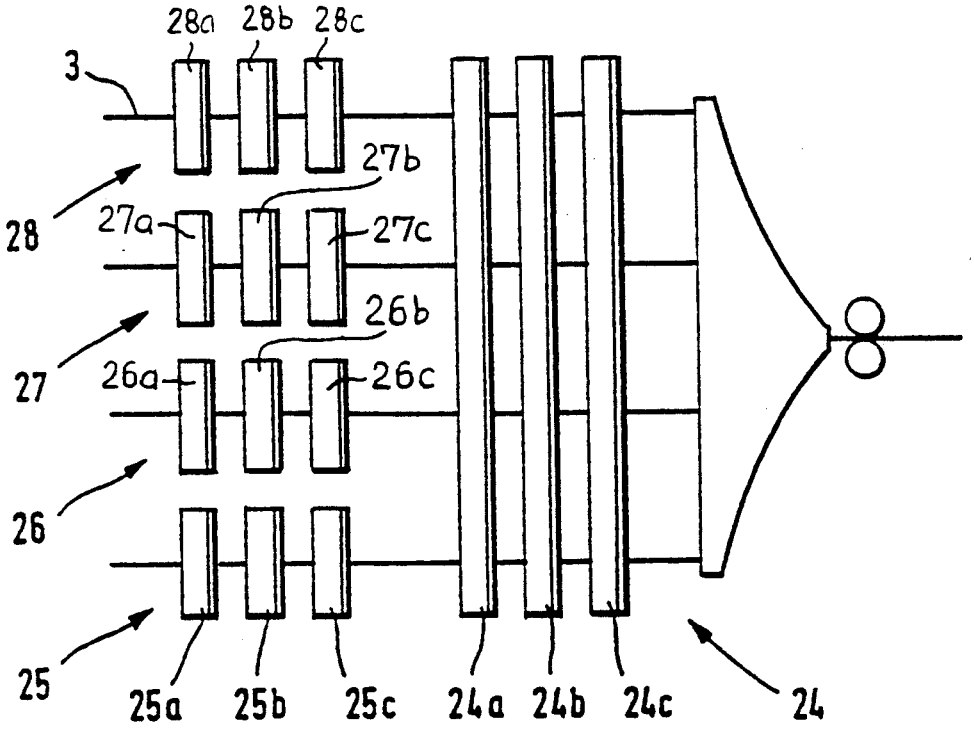
FIG. 5 is a schematic top plan view of still a further preferred embodiment of the invention.

FIG. 5 illustrates an embodiment in which the main drafting mechanism 24 having roll pairs 24*a*, 24*b* and 24*c*, each composed of throughgoing (long) rolls, is preceded by four pre-drafting mechanisms 25, 26, 27 and 28 each formed of three rpm-regulatable individual roll pairs 25*a*, 25*b*, 25*c*; 26*a*, 26*b*, 26*c*; 27*a*, 27*b*, 27*c*; and 28*a*, 28*b* and 28*c*.

It will be understood that the above description of the present invention is susceptible to various modifications, changes and adaptations, and the same are intended to be comprehended within the meaning and range of equivalents of the appended claims.

What is claimed is:

1. A sliver drafting apparatus comprising (a) a pre-drafting mechanism arranged for simultaneously receiving a plurality of spaced running slivers; the pre-drafting mechanism including (1) a first pair of drafting rolls, formed of a lower roll and an upper roll, between which the slivers pass in a running direction; and (2) a second pair of drafting rolls, formed of a lower roll and an upper roll, between which the slivers pass; said second pair of drafting rolls being situated downstream of the first pair as viewed in the running direction of the slivers;

(b) a gathering element disposed downstream of said second pair and being arranged for gathering the slivers into a combined sliver;

(c) a first delivery roll pair situated downstream of said gathering element for pulling the combined sliver from the gathering element;

(d) a main drafting mechanism arranged downstream of said first delivery roll pair and being arranged for receiving the combined sliver from said first delivery roll pair; the main drafting mechanism including (1) a first pair of drafting rolls, formed of a lower roll and an upper roll, between which the combined sliver passes; and (2) a second pair of drafting rolls, formed of a lower roll and an upper roll, between which the combined sliver passes; said second pair of drafting rolls of said main drafting mechanism being situated downstream of the first pair of drafting rolls of said main drafting mechanism;

(e) a sliver trumpet situated downstream of said main drafting mechanism for receiving the combined sliver therefrom;

(f) a second delivery roll pair situated downstream of said sliver trumpet for pulling the combined sliver from the sliver trumpet;

(g) a separate regulatable drive motor connected to each said lower roll, said first delivery roll pair and said second delivery roll pair;

(h) a control and regulating device connected to the regulatable drive motors; and (i) a separate rpm sensor connected to each said upper roll, each said lower roll, said first delivery roll pair and said second delivery roll pair for sensing the rpm thereof; said control and regulating the device being connected to the rpm sensors; said control and regulating device adjusting the rpm as a function of signals received from the rpm sensors.

2. A sliver drafting apparatus as defined in claim 1, further comprising mass sensor means for sensing the mass of sliver running through the pre and main drafting mechanisms; said mass sensor means being connected to said control and regulating device.

3. A sliver drafting apparatus as defined in claim 1, wherein each lower roll extends across and below a running path of each said sliver, whereby each lower roll engages all the slivers.

4. A sliver drafting apparatus as defined in claim 3, wherein each upper roll extends across and above the running path of each said sliver, whereby each upper roll engages all the slivers.

5. A sliver drafting apparatus as defined in claim 3, wherein each roll pair has a plurality of axially serially arranged upper rolls, each extending across and above the running path of a single, different sliver, whereby each upper roll engages a single sliver.

6. A sliver drafting apparatus as defined in claim 5, further comprising separate support means for radially separately movably supporting each upper roll for allowing displacements thereof towards and away from a respective said lower roll.

7. A sliver drafting apparatus as defined in claim 6, wherein each said support means includes a spring urging each said upper roll separately towards the respective lower roll.

8. A sliver drafting apparatus comprising (a) a pre-drafting mechanism arranged for simultaneously receiving a plurality of spaced running slivers; the pre-drafting mechanism including (1) a first pair of drafting rolls between which the slivers pass in a running direction; and (2) a second pair of drafting rolls between which the slivers pass; said second pair of drafting rolls being situated downstream of the first pair as viewed in the running direction of the slivers;

(b) a gathering element disposed downstream of said second pair and being arranged for gathering the slivers into a combined sliver;

(c) a first delivery roll pair situated downstream of said gathering element for pulling the combined sliver from the gathering element;

(d) a main drafting mechanism arranged downstream of said first delivery roll pair and being arranged for receiving the combined sliver from said first delivery roll pair; the main drafting mechanism including (1) a first pair of drafting rolls between which the combined sliver passes; and (2) a second pair of drafting rolls between which the combined sliver passes; said second pair of drafting rolls of said main drafting mechanism being situated downstream of the first pair of drafting rolls of said main drafting mechanism;

(e) a sliver trumpet situated downstream of said main drafting mechanism for receiving the combined sliver therefrom;

(f) a second delivery roll pair situated downstream of said sliver trumpet for pulling the combined sliver from the sliver trumpet;

(g) a plurality of driving means connected to the pairs of drafting rolls of said pre-drafting mechanism and said main drafting mechanism for rotating the pairs of drafting rolls;

(h) sensor means connected to the pairs of drafting rolls of said pre-drafting mechanism and said main drafting mechanism for determining the rpm of said pairs of drafting rolls;

(i) a regulator connected to said sensor means and said driving means; and (j) a desired value memory connected to said regulator; said regulator adjusting the rpm of said driving means as a function of a difference between the rpm sensed by said sensor means and a desired rpm value stored in said desired value memory.

* * * * *